United States Patent [19]

Doyle

[11] Patent Number: 4,839,483

[45] Date of Patent: Jun. 13, 1989

[54] MODULAR WATERTIGHT SWITCH FOR USE IN PERSONAL CARE APPLIANCES

[75] Inventor: Edward J. Doyle, Hatboro, Pa.

[73] Assignee: Conair Corporation, Stamford, Conn.

[21] Appl. No.: 921,751

[22] Filed: Oct. 22, 1986

[51] Int. Cl.[4] ..... H01H 9/04

[52] U.S. Cl. ..... 200/302.1; 200/275; 200/284

[58] Field of Search ..... 200/302.1, 302.3, 329, 200/330, 278, 275, 291, 6 BA, 284, 252, 260

[56] References Cited

U.S. PATENT DOCUMENTS

| | | | |
|---|---|---|---|
| 2,457,153 | 12/1948 | Hubbell | 200/302.1 |
| 3,689,723 | 9/1972 | Ludwig | 200/339 |
| 3,719,788 | 3/1973 | Holland et al. | 200/292 |
| 3,723,692 | 3/1973 | Wilbrecht | 200/302.1 |
| 3,742,171 | 6/1973 | Howe | 200/302.3 |
| 4,057,520 | 11/1977 | Schwartz | 200/292 |
| 4,170,104 | 10/1979 | Yamagata | 200/302.1 |
| 4,324,956 | 4/1982 | Sakakino et al. | 200/302.1 |
| 4,427,006 | 1/1984 | Nottke | 200/159 B |

FOREIGN PATENT DOCUMENTS

| | | | |
|---|---|---|---|
| 0081929 | 6/1983 | European Pat. Off. | 200/302.1 |
| 2447086 | 1/1979 | France | 200/252 |

*Primary Examiner*—Henry J. Recla
*Assistant Examiner*—Linda J. Sholl
*Attorney, Agent, or Firm*—Haynes N. Johnson

[57] ABSTRACT

A modular water proof switch which can be easily assembled, having a housing and cover secured together with complementary interfitting latches, a slide switch in the cover and containing a rocker switch actuator, a sealed flexible diaphragm between the cover and housing, a rocker switch within the housing beneath the diaphragm controlling a pair of connecting plates, the switch being controlled by the actuator and being connected to a pair of input terminals leading to the exterior of the housing, a pair of output terminals associated with the rocker switch and leading to the exterior of the housing, an external extension of the housing defining an interconnect chamber for receiving a line cord and connecting it with the input terminals, and sealing means providing a waterproof seal within the interconnect chamber. The inner ends of the input terminals provide both a fulcrum and a connection for the rocker switch and, for ease of assembly, the inner ends pass through slots in the connecting plates.

2 Claims, 3 Drawing Sheets

Fig. 1.
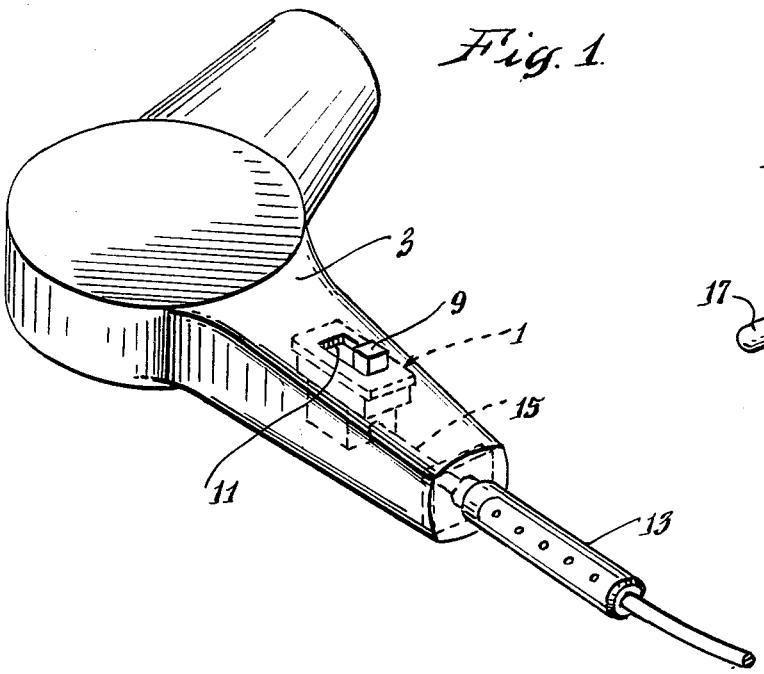
Fig. 2.
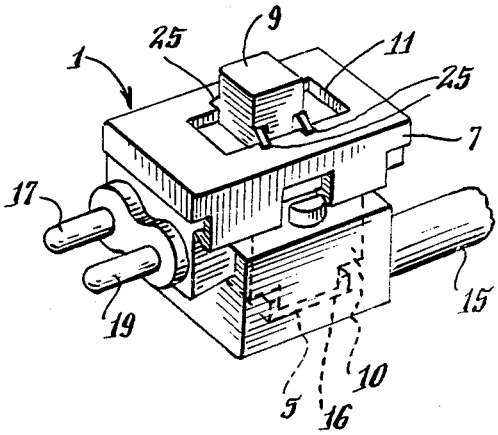
Fig. 3.
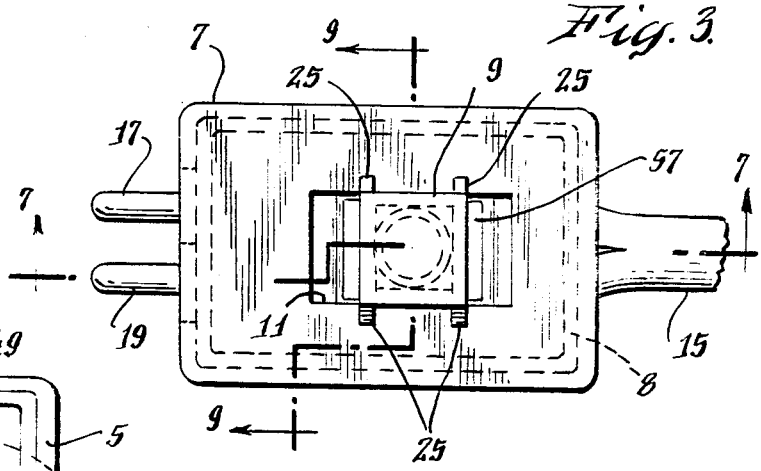
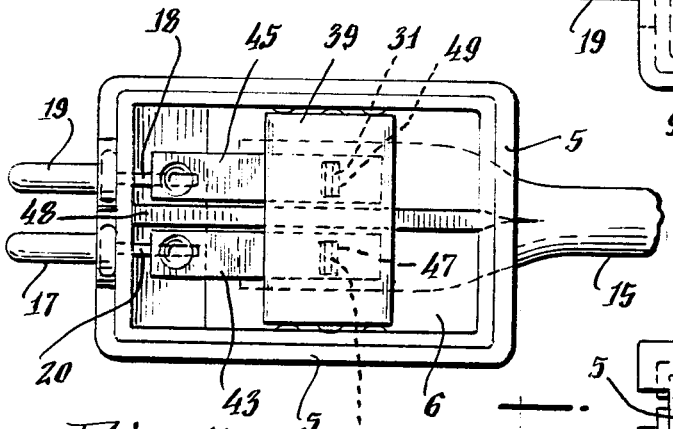
Fig. 5.
Fig. 4.
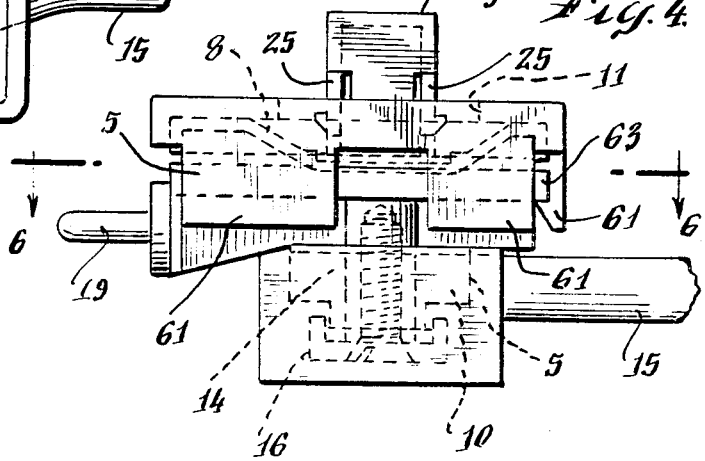

Fig. 7.
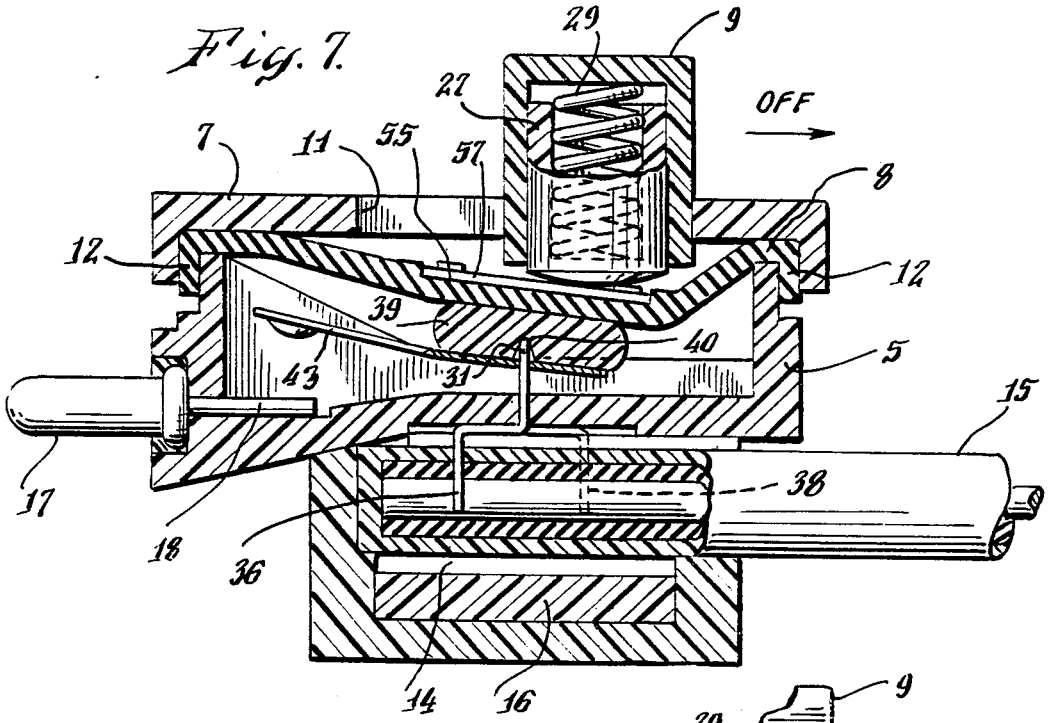
Fig. 8.
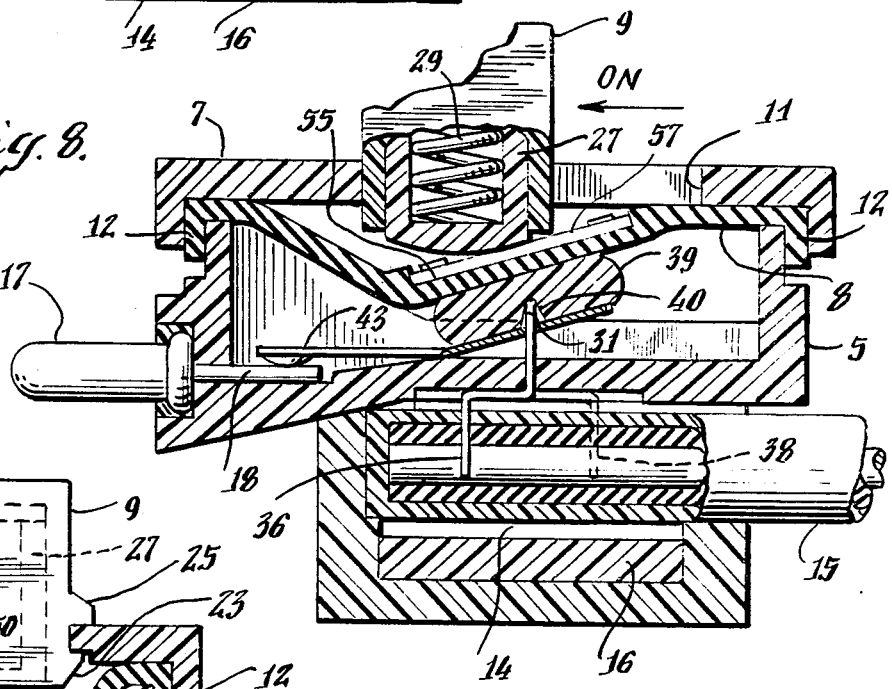
Fig. 9.
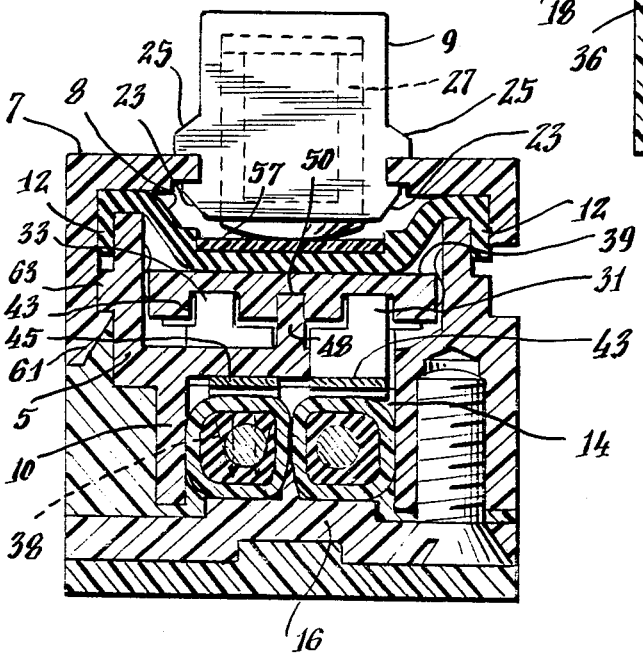
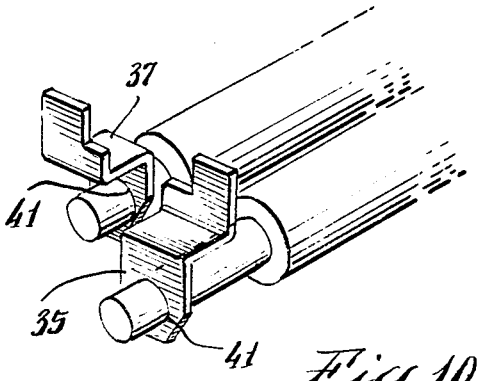
Fig. 10.

MODULAR WATERTIGHT SWITCH FOR USE IN PERSONAL CARE APPLIANCES

FIELD OF THE INVENTION

This invention relates to the field of personal care appliances, such as hair dryers, and, in particular, to very small watertight switches for use in such appliances.

A need for watertight switches has arisen in the past few years due to a series of accidents which have occurred in the use of personal care appliances. These accidents have resulted from situations such as dropping a hair dryer into a filled bathtub or basin, sometimes resulting in electrocution.

Prior switches have often been single pole, thus not disconnecting the entire circuit, have been too large to fit within the narrow confines of a dryer handle, and have been expensive to manufacture relative to the costs of manufacturing the dryer itself.

The present switch has a modular, snap-fit design, permitting easy, yet reliable, assembly. It is double pole for sure operation.

Waterproof switches as such are, of course, not new. They are found, for example, in Hubbell U.S. Pat. No. 2,457,153, Sakakino et al. U.S. Pat. No. 4,324,956, and Aschenback et al. U.S. Pat. Nos. 4,335,287 and 4,452,398. These patents, however, do not disclose the full concept of my present invention.

BRIEF SUMMARY OF THE INVENTION

My switch controls the power on both lines of an electrical cord, i.e., it is double pole. It is positioned in the line at the first point of connection of the line with the appliance; and, since it is waterproof, it cannot be short-circuited in the event of contact with water. The incoming line is sealed to the switch and leaves the appliance through a strain-relief member, thus avoiding any possible short circuit.

The switch includes an external physical control section, having a slide switch button, and a watertight actuating chamber or housing operatively associated with the physical control section through a flexible rubber diaphragm sealed to the housing. Input and output terminals enter the housing through sealed terminals. Force from the button presses against the diaphragm and causes a rocker arm bearing contacts to rotate to one or the other of two possible positions, thus opening and closing the two contacts of the switch. The pivot point (fulcrum) for the rocker arm is formed by the inner ends of piercing blades used to interconnect the pivots with the incoming line cord. The piercing blades receive and are connected to the line cord within a closed and sealed interconnect chamber. This chamber is potted to provide an even greater seal.

The switch is assembled from modular, snap-together parts including a housing, a diaphragm, a cover with a snap-in slide switch, and a clamping plate. The cover and slide switch are exposed and do not need to be waterproof; the switch button functions through the diaphragm to actuate the contacts within the waterproof housing.

DESCRIPTION OF THE DRAWINGS

FIG. 1 is a perspective view of a personal care appliance, in this instance a hair dryer, using my watertight switch.

FIG. 2 is a perspective view of the switch itself.

FIG. 3 is a top plan view of the switch.

FIG. 4 is a side elevation of the switch.

FIG. 5 is a bottom plan view of the switch.

FIG. 7 is a vertical section, taken on line 7—7 of FIG. 3, showing the switch in the "Off" position.

FIG. 8 is similar to FIG. 7, except that the switch is in the "On" position.

FIG. 9 is a vertical section, taken on line 9—9 of FIG. 3.

FIG. 10 is a modification, showing a different method for interconnecting the switch with the entering electrical line.

DETAILED DESCRIPTION OF THE INVENTION

Figure 6:
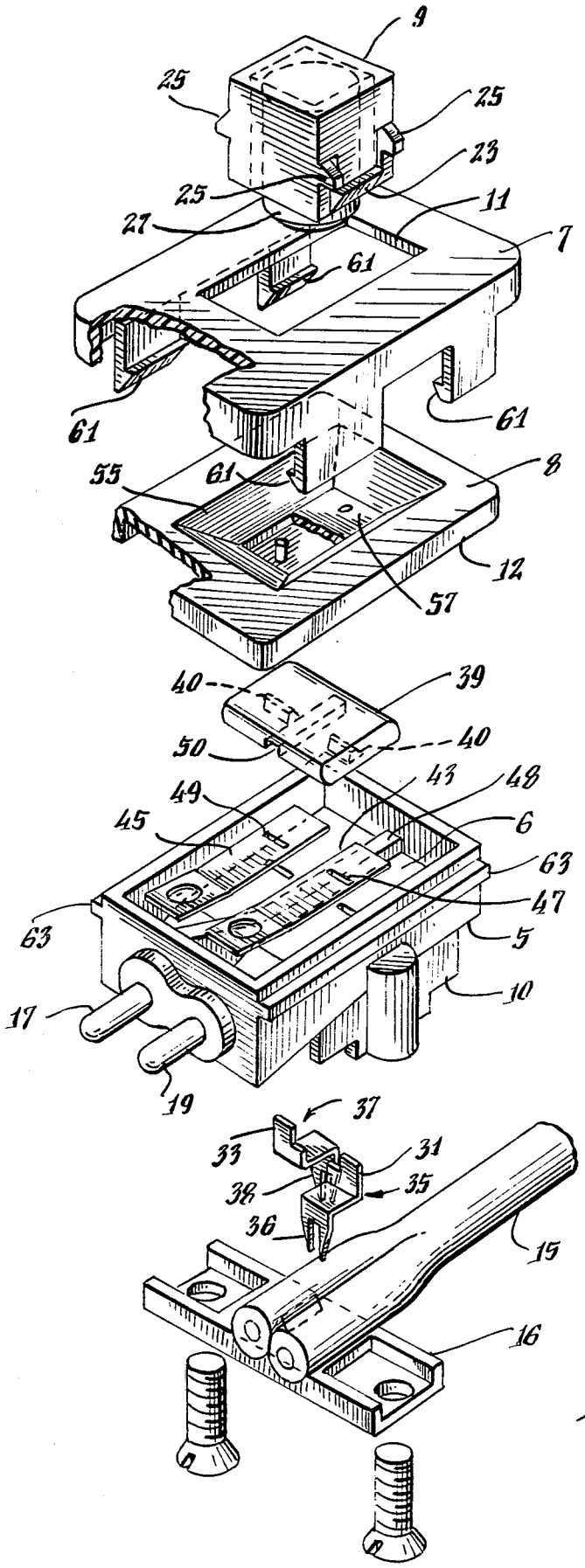
FIG. 6 is an exploded view to illustrate the modular method of assembly of the switch.

My miniature, modular waterproof switch 1 is shown mounted in the handle of a hair dryer 3 in FIG. 1. A perspective view of swtich 1 itself is seen in FIG. 2. The modular, snap-together features providing for ready assembly may be seen in the exploded view of FIG. 6.

Switch 1 is formed of a hard rubber housing 5 with a snap-on polycarbonate cover 7. Cover 7 has the button 9 of the slide switch mounted in slot 11. A flexible rubber diaphragm 8 with peripheral lips 12 seals housing 5 along its upper edge and separates housing 5 from cover 7. A line interconnect chamber 14 is formed by downwardly extending sides 10 of housing 5 and line cord clamp 16; it is to receive incoming line cord 15. Chamber 14 is sealed with potting compound.

The incoming electric line 15 enters the appliance 3 through strain relief member 13 and is connected to the switch in a manner to be described below; and outlet terminals 17 and 19, with inner contacts 18 and 20, lead from the switch to the inside of the hair dryer or other personal care appliance 3. Terminals 17 and 19 are sealed in position with an epoxy resin at the point where they pass through the wall of housing 5. Terminals 17 and 19 are connected to the heating coils, blower fan, etc. of the personal care appliance.

When switch 1 is "Off", there is no power on either of the terminals 17 and 19, and, so, risk of pesonal injury is eliminated.

Button 9 has a series of resilient latch members 23 and corresponding stops 25 to hold it in sliding engagement within slot 11 of cover 7. The latch members are dimensioned to allow the button 9 to be pressed into slot 11 from the top of cover 7 and to be held there, with the latch members engaging the undersurface of cover 7, and the stops engaging the upper surface.

The inner end of button 9 is open and has a spring-pressed actuator 27 within it and a coil spring 29 within the actuator. This causes the actuator 27 to be pressed downwardly against diaphragm 8, to actuate the switch.

As mentioned, the upper area of housing 5 is covered by diaphragm 8. This diaphragm includes sealing lips 12 which fit tightly around the upper circumference of the housing 5. Cover 7 fits about housing 5 and about the lips 12 of the diaphragm 8. Cover 7 includes a series of resilient, downwardly-extending bevelled latches 61 positioned for complementary latching engagement with a series of interengaging stops 63 on the outer surface of housing 5.

Diaphragm 8 includes a recess 55 above rocker arm 39 to receive a contact pad 57. This pad has a Mylar surface to receive the inner end of actuator 27 and to allow it to slide easily. As can be seen, the diaphragm is positioned above rocker arm 39 and below spring-pressed actuator 27.

The switch elements themselves are located within housing 5 (which is sealed by the diaphragm 8). Metal contact bases 35 and 37, one for each side of the circuit, pierce the bottom 6 of housing 5. These bases include vertically projecting arms 31 and 33, a horizontal portion outside the housing and pressing against the bottom, and lower line-piercing points 36 and 38.

Housing 5 has downwardly-extending sides 10 forming a U-shaped interconnect chamber 14 to receive incoming line cord 15. To install the cord, it is pressed against the protruding line-piercing points 36 and 38 so that the points enter the cord and make piercing contact. As can be seen, the points enter the cord at different longitudinal positions along its length. This interconnection is more readily accomplished by pressing the line cord clamp 16 into position against cord 15, causing the points to pierce the cord. Clamp 16 is tightened and held in place by screws. The line entry area within sides 10 is potted with silicone or its equivalent to make it watertight.

Additional protection for the line cord 15 can be had by using a strain reliever 13 at the point that the line enters dryer 3. This is preferably of the type shown in U.S. Pat. No. 4,255,066.

FIG. 10 shows a modified form of contact base. Here, in lieu of piercing points 36 and 38, the base has a lower opening 41 in each unit to receive the wire.

Turning to the internal structure of switch 1, it can be seen that a rocker arm 39 is pivoted about the top of the vertical arms 31 and 33. Two resilient metal contact plates 43 and 45, with slots 47 and 49 in them to fit about the vertical arms, are mounted for rocking movement about the arms 31 and 33 and are held beneath and against rocker arm 39. The arms are connected to line-piercing points 36 and 38 and so complete the circuit to incoming line 15. Plates 43 and 45 extend to the left (as seen in FIGS. 7 and 8) where they can contact the inner ends 18 and 20 of outlet terminals 17 and 19.

Rocker arm 39 has a transverse notch or slot 40 which, together with the upper ends of vertical arms 31 and 33 forms a fulcrum about which rocker arm 39 can pivot. Housing 5 may also include a longitudinal, vertical gate 48 for separating contact plates 43 and 45; in such event rocker arm 39 would include a complementary slot 50 to receive the gate.

When arm 39 is rotated clockwise as shown in FIG. 7, plates 43 and 45 are not in contact with terminal ends 18 and 20, and the switch is "Off". When rotated counterclockwise as in FIG. 8, they are in contact, and the switch is "On". As can be seen, this is a double pole switch, and so the circuit from switch 1 to the dryer itself is completely open (disconnected) on both sides when the switch is "Off".

The method of assembly is, perhaps, best understood by referring to FIG. 6. Contact bases 35 and 36 are pressed through the bottom 6 of housing 5; and terminals 17 and 19 are pressed through from the side and sealed in epoxy resin. The slots 47 and 49 in contact plates 43 and 45 are then fitted over the vertical arms 31 and 33 so that their ends can contact inner terminals 18 and 20, and rocker arm 39 placed over them. The diaphragm 8 is then placed over the housing 5 to seal it, and contact pad 57 placed within it. The cover 7 with the button assembly installed is then snapped into place over the diaphragm and housing. After installing the strain relief member on the cord 15, the cord is then pressed into interconnect chamber 14, as above described, with the line cord clamp over 16 it, and potted.

In use, as can be seen in FIGS. 7 and 8, the spring-pressed actuator 27 presses against contact pad 57 which, in turn, through the diaphragm, presses against pivoted rocker arm 39.

By sliding button 9 in one direction or another, the actuator 27 is pressed downwardly against one end or the other of rocker arm 39. This served to turn the switch "Off" as in FIG. 7 (contact plates 43 and 45 not touching terminals 18 and 20), or "On" as in FIG. 8 (contact plates touching the terminals).

Thus, a very small, modular, double pole switch system has been provided which will readily fit within small areas, such as the handle on a hair dryer. It is not only waterproof in itself, but also is integrally bonded to the line cord, so that the system itself is waterproof. Thus, when the switch is "Off", no short circuit can be created by the presence of water.

I claim:

1. A miniature, modular waterproof double-pole personal care appliance switch system capable of carrying line voltage and capable of easy assembly, said switch system including a housing, a covering diaphragm therefor, and a cover plate, said cover plate and said housing having complementary interengaging members for permanent snap-fit assembly, and said diaphragm being in waterproof sealing engagement with said housing and positioned between said housing and said cover plate;

said cover plate including a slide-switch button and an associated actuator, said actuator being biased towards said diaphragm, a pair of input terminals entering said housing and a pair of output terminals leaving said housing, both pairs of terminals being sealed to said housing, a rocker arm pivoted about a fixed point and so positioned within said housing as to be operatively associated with said actuator and said diaphragm, a pair of contacts carried by said rocker arm to connect and disconnect said input and said output terminals in response to motion of said rocker arm, an input line cord sealed to said input terminals, a slot in said cover plate and in which said button is positioned within said slot, and including complementary latch members on said cover plate and said button for snap-fit positioning of said button within said slot, said actuator being positioned within said button and being spring-biased towards said diaphragm, and a recess in said diaphragm proximate to said actuator and a contact pad conforming to the shape of said recess and positioned in said recess, for receiving forces from said actuator, whereby sliding said button serves to rotate said rocker arm and thereby open and close said switch.

2. A modular waterproof personal care appliance switch capable of carrying line voltage and adapted for ready assembly including a housing, a cover therefor, said housing and cover having complementary interfitting latch members for permanently securing together said housing and said cover, a slide switch slidingly secured in said cover, a rocker switch assembly positioned within said housing and connected to a pair of input terminals leading to the exterior thereof, a pair of output terminals operatively associated with said rocker switch and leading to the exterior of said housing, all of said terminals being sealed to said housing, a diaphragm secured between said cover and said housing and in sealing engagement with said housing, an actuator within said slide switch, said actuator being spring-pressed towards said rocker switch and, through said diaphragm, being operatively associated with said rocker switch, and said diaphragm being recessed proximate to said actuator and including a contact pad in said recess, said pad having a shape complementary to said recess to interfit with same, whereby actuation of said slide switch will actuate said rocker switch, and said switch will be waterproof.

* * * * *